US005979848A

United States Patent [19]

Kuthy et al.

[11] Patent Number: 5,979,848

[45] Date of Patent: Nov. 9, 1999

[54] CURTAIN AND MINI BLIND HANGER

[76] Inventors: James Kuthy; Debra Kuthy, both of R.D. #2 Box 421AA, Triadelphia, W. Va. 26059

[21] Appl. No.: 09/070,657

[22] Filed: Apr. 30, 1998

[51] Int. Cl.[6] ..... A47H 1/10

[52] U.S. Cl. ..... 248/261; 160/902; 248/265

[58] Field of Search ..... 218/251, 254, 218/256, 261, 262, 265, 208; 160/902, 330

[56] References Cited

U.S. PATENT DOCUMENTS

| | | | |
|---|---|---|---|
| 1,228,531 | 6/1917 | Cavanaugh | 248/254 |
| 1,354,974 | 10/1920 | Hunter | 248/254 |
| 3,029,465 | 4/1962 | Graber et al. | 248/265 X |
| 4,140,294 | 2/1979 | Zwarts | 278/265 |
| 4,824,062 | 4/1989 | Wagner | 248/265 |
| 5,520,235 | 5/1996 | Coleman | 248/261 X |
| 5,678,797 | 10/1997 | Gogan | 248/251 |

*Primary Examiner*—Ramon O. Ramirez

[57] ABSTRACT

A window covering hanger is provided including a mounting bracket having a horizontally oriented top face and a vertically oriented rear face coupled to a rear edge of the top face and depending downwardly therefrom. A front face is coupled to a front edge of the top face and depends downwardly therefrom. The top face of the mounting bracket rests on a top ledge of a window frame and the rear face is situated between the window frame and an adjacent wall. A securement mechanism is mounted on the mounting bracket for securing to an end of a rod of a window covering.

9 Claims, 2 Drawing Sheets

CURTAIN AND MINI BLIND HANGER

BACKGROUND OF THE INVENTION

1. Field of the Invention

The present invention relates to curtain hangers and more particularly pertains to a new curtain and mini blind hanger for conveniently hanging a curtain or mini blind.

2. Description of the Prior Art

The use of curtain hangers is known in the prior art. More specifically, curtain hangers heretofore devised and utilized are known to consist basically of familiar, expected and obvious structural configurations, notwithstanding the myriad of designs encompassed by the crowded prior art which have been developed for the fulfillment of countless objectives and requirements.

Known prior art curtain hangers include U.S. Pat. No. 4,961,296; U.S. Pat. No. 4,322,050; U.S. Pat. No. 5,230,494; U.S. Pat. Des. 384,604; U.S. Pat. No. 5,063,718; and U.S. Pat. No. 4,986,046.

In these respects, the curtain and mini blind hanger according to the present invention substantially departs from the conventional concepts and designs of the prior art, and in so doing provides an apparatus primarily developed for the purpose of conveniently hanging a curtain or mini blind.

SUMMARY OF THE INVENTION

In view of the foregoing disadvantages inherent in the known types of curtain hangers now present in the prior art, the present invention provides a new curtain and mini blind hanger construction wherein the same can be utilized for conveniently hanging a curtain or mini blind.

The general purpose of the present invention, which will be described subsequently in greater detail, is to provide a new curtain and mini blind hanger apparatus and method which has many of the advantages of the curtain hangers mentioned heretofore and many novel features that result in a new curtain and mini blind hanger which is not anticipated, rendered obvious, suggested, or even implied by any of the prior art curtain hangers, either alone or in any combination thereof.

To attain this, the present invention generally comprises a mounting bracket having a horizontally oriented top face with a planar rectangular configuration. The top face has a pair of spaced bores formed therein for reasons that will soon become apparent. A vertically oriented rear face is included with a size and shape similar to that of the top face. The rear face is integrally coupled to a rear edge of the top face and depends downwardly therefrom in perpendicular relationship therewith. The bracket further includes a vertically oriented front face with a height at least three times that of the rear face. The front face is integrally coupled to a front edge of the top face and depends downwardly therefrom in perpendicular relationship therewith. The front face has inwardly tapering side edges. Further, as shown in FIG. 4, the front face includes an L-shaped spacer lip integrally coupled to a bottom edge thereof and extending inwardly therefrom. During use, the top face of the mounting bracket rests on a top ledge of a window frame. See FIG. 6. Further, unillustrated tacks extend through the apertures for engaging the window frame. The rear face is situated between the window frame and an adjacent wall. The spacer lip of the front face serves to maintain the front face in spaced parallel relationship with the window frame. With reference to FIG. 4, an extension plate is integrally coupled to one of the side edges of the front face adjacent to the top face of the bracket in coplanar relationship therewith. The extension plate has a top face, a bottom face and an outer side face integrally coupled thereto and extending perpendicularly therefrom. By this structure, a box is defined with an open front face and an open inner side face. The inner surface of the box has a groove formed therein adjacent to a periphery of the open front face for releasably receiving a square planar plate. As such, a compartment is provided for housing a window covering rod.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new curtain and mini blind hanger apparatus and method which has many of the advantages of the curtain hangers mentioned heretofore and many novel features that result in a new curtain and mini blind hanger which is not anticipated, rendered obvious, suggested, or even implied by any of the prior art curtain hangers, either alone or in any combination thereof.

It is another object of the present invention to provide a new curtain and mini blind hanger which may be easily and efficiently manufactured and marketed.

It is a further object of the present invention to provide a new curtain and mini blind hanger which is of a durable and reliable construction.

An even further object of the present invention is to provide a new curtain and mini blind hanger which is susceptible of a low cost of manufacture with regard to both materials and labor, and which accordingly is then susceptible of low prices of sale to the consuming public, thereby making such curtain and mini blind hanger economically available to the buying public.

Still yet another object of the present invention is to provide a new curtain and mini blind hanger which provides in the apparatuses and methods of the prior art some of the advantages thereof, while simultaneously overcoming some of the disadvantages normally associated therewith.

Still another object of the present invention is to provide a new curtain and mini blind hanger for conveniently hanging a curtain or mini blind.

Even still another object of the present invention is to provide a new curtain and mini blind hanger that includes a mounting bracket having a horizontally oriented top face and a vertically oriented rear face coupled to a rear edge of the top face and depending downwardly therefrom. A front face is coupled to a front edge of the top face and depends downwardly therefrom. The top face of the mounting bracket rests on a top ledge of a window frame and the rear face is situated between the window frame and an adjacent wall. A securement mechanism is mounted on the mounting bracket for securing to an end of a rod of a window covering.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
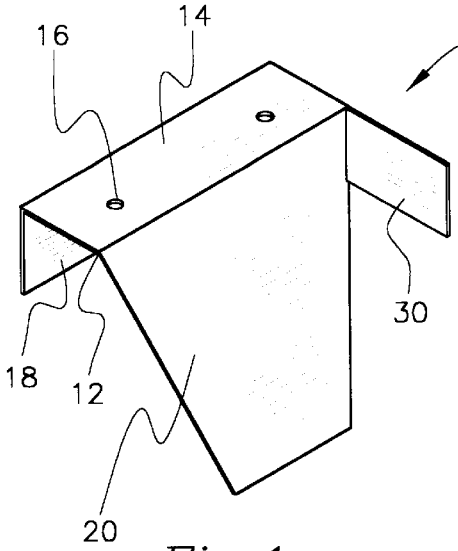
FIG. 1 is a perspective view of a new curtain and mini blind hanger according to the present invention.

With reference now to the drawings, and in particular to FIGS. 1 through 7 thereof, a new curtain and mini blind hanger embodying the principles and concepts of the present invention and generally designated by the reference numeral 10 will be described.

The present invention, designated as numeral 10, includes a mounting bracket 12 having a horizontally oriented top face 14 with a planar rectangular configuration. The top face has a pair of spaced bores 16 formed therein for reasons that will soon become apparent. A vertically oriented rear face 18 is included with a size and shape similar to that of the top face. The rear face is integrally coupled to a rear edge of the top face and depends downwardly therefrom in perpendicular relationship therewith.

Figure 4:
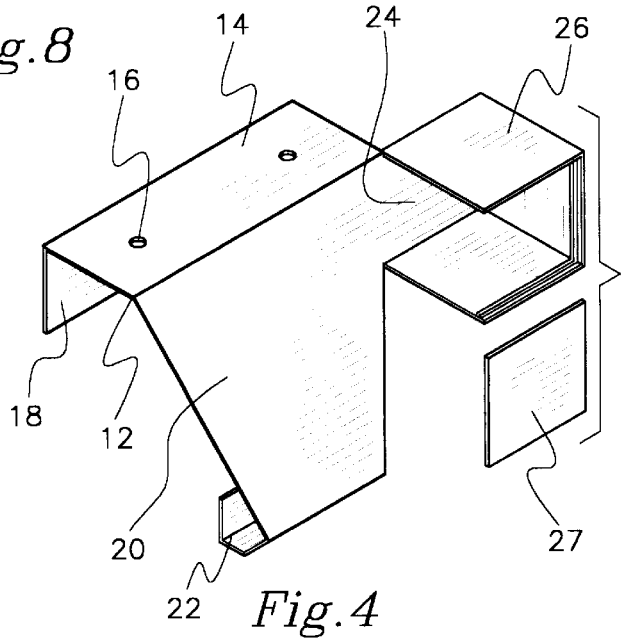
FIG. 4 is a perspective view of still yet another alternate embodiment of the present invention.
Figure 5:
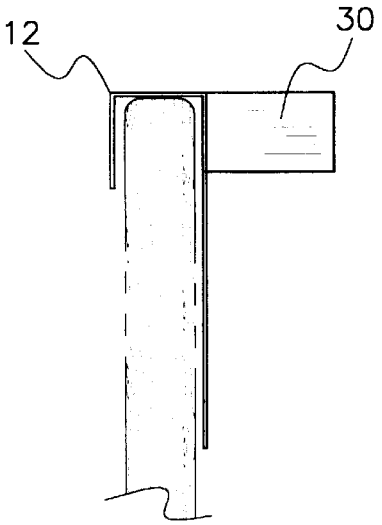
FIG. 5 is a side view of the embodiment of FIG. 1 in use.
Figure 6:
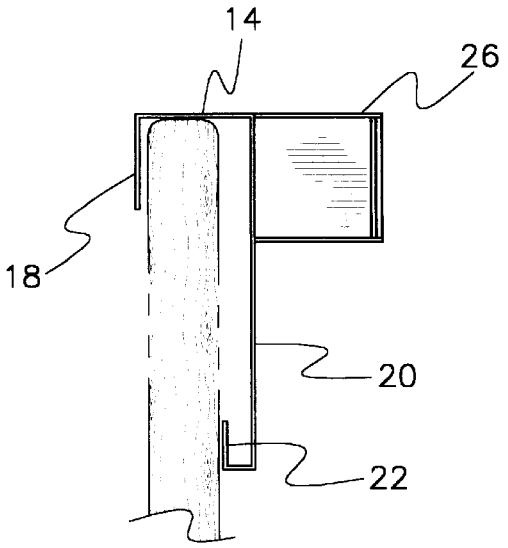
FIG. 6 is a side view of the embodiment of FIG. 4 in use.
Figure 7:
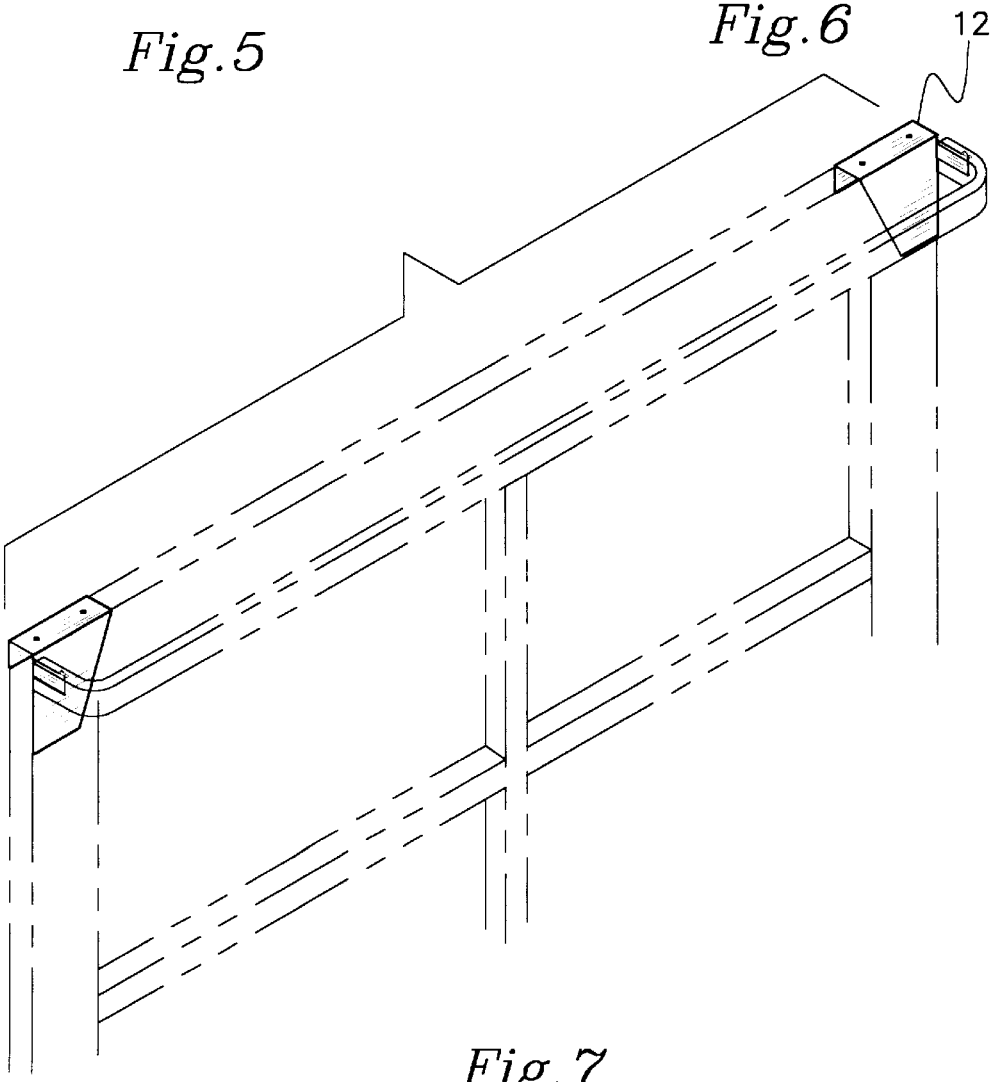
FIG. 7 is a perspective view of the present invention.

The bracket further includes a vertically oriented front face 20 with a height at least three times that of the rear face. The front face is integrally coupled to a front edge of the top face and depends downwardly therefrom in perpendicular relationship therewith. The front face has inwardly tapering side edges. Further, as shown in FIG. 4, the front face includes an L-shaped spacer lip 22 integrally coupled to a bottom edge thereof and extending inwardly therefrom. The spacer lip preferably extends along an entire length of the bottom edge.

During use, the top face of the mounting bracket rests on a top ledge of a window frame. See FIGS. 6 & 7. Further, unillustrated tacks extend through the apertures for engaging the window frame. The rear face is situated between the window frame and an adjacent wall. The spacer lip of the front face serves to maintain the front face in spaced parallel relationship with the window frame.

With reference to FIG. 4, an extension plate 24 is integrally coupled to one of the side edges of the front face adjacent to the top face of the bracket in coplanar relationship therewith. The extension plate has a top face, a bottom face and an outer side face integrally coupled thereto and extended perpendicularly therefrom. By this structure, a box 26 is defined with an open front face and an open inner side face. The inner surface of the box has a groove formed therein adjacent to a periphery of the open front face for releasably receiving a square planar plate 27. As such, a compartment is provided for housing a window covering rod of a mini-blind. Ideally, a length of the box is about ½ that of the bracket.

Figure 2:
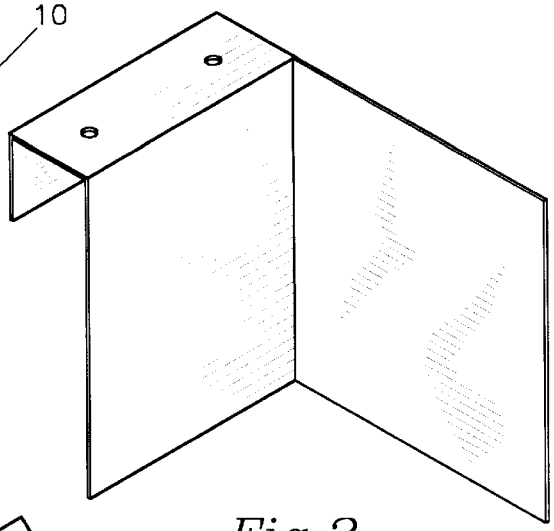
FIG. 2 is a perspective view of another embodiment of the present invention.
Figure 3:
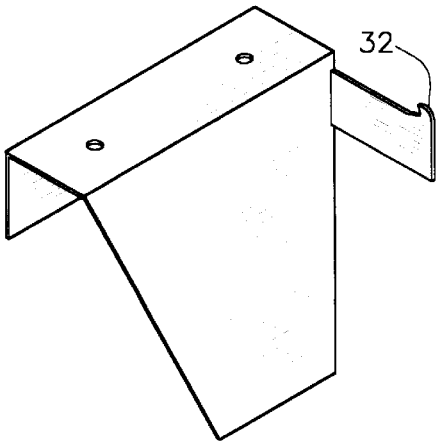
FIG. 3 is a perspective view of yet another alternate embodiment of the present invention.

In various other embodiments, the spacer lip and compartment may be excluded in favor of a vertically oriented tab 30 which serves as an alternate securement means. As shown in FIG. 1, the tab extends outwardly from the front face of the mounting bracket and has a planar rectangular configuration for being inserted within a curtain rod. As shown in FIG. 3, the tab may be modified by adding an upwardly extending lip 32 coupled to an outboard end of the tab. FIG. 2 shows a further modification wherein the tab has a height equal to that of the front face and the front face has a height at least three times that of the rear face for accommodating large valance rods. In the embodiment of FIG. 2, the tab further preferably extends outwardly a distance approximately equal to a width of the bracket.

Figure 8:
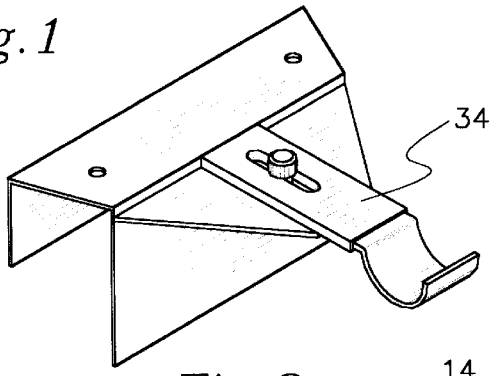
FIG. 8 is a perspective view of another embodiment of the present invention.

Finally, FIG. 8 shows still yet another modification wherein the tab is extendible. This is accomplished via a sleeve 34 mounted on the top face and extending downwardly and outwardly therefrom with a slot formed on a top face thereof. An arm with an arcuate cup on an outboard end thereof is slidably situated within the sleeve and selectively fixable by way of a set screw which extends upwardly through the slot.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A window covering hanger comprising, in combination:

a mounting bracket including a horizontally oriented top face with a planar rectangular configuration having a pair of spaced bores formed therein, a vertically oriented rear face with a size and shape similar to that of the top face and integrally coupled to a rear edge of the top face and depending downwardly therefrom in perpendicular relationship therewith, and a vertically oriented front face with a height at least three times that of the rear face integrally coupled to a front edge of the top face and depending downwardly therefrom in perpendicular relationship therewith, the front face having inwardly tapering side edges and an L-shaped spacer lip integrally coupled to a bottom edge thereof and extending inwardly therefrom, wherein the top face of the mounting bracket rests on a top ledge of a window frame with tacks extending through the apertures for engaging the window frame and the rear face is situated between the window frame and an adjacent wall such that the front face is spaced in parallel relationship with the window frame via the spacer lip; and an extension plate integrally coupled to one of the side edges of the front face adjacent to the top face of the bracket and extending therefrom in coplanar relationship therewith, the extension plate having a top face, a bottom face and an outer side face integrally coupled thereto and extending perpendicularly therefrom for defining a box with an open front face and an open inner side face, the inner surface of the box having a groove formed therein adjacent to a periphery of the open front face for releasably receiving a square planar plate thereby affording a compartment for housing a window covering rod.

2. A window covering hanger comprising:

a mounting bracket including a horizontally oriented top face, a vertically oriented rear face coupled to a rear edge of the top face and depending downwardly therefrom, and a front face coupled to the top face and depending downwardly therefrom, wherein the top face of the mounting bracket rests on a top ledge of a window frame and the rear face is situated between the window frame and an adjacent wall; and securement means mounted on the mounting bracket for securing to an end of a rod of a window covering;

wherein the securement means includes a compartment for receiving the end of the rod;

wherein the compartment has a removable front face.

3. A window covering hanger as set forth in claim 2 wherein the securement means is coupled to the front face of the mounting bracket.

4. A window covering hanger as set forth in claim 2 wherein the top face has at least one aperture formed therein with a tack extending through the aperture for engaging the window frame.

5. A window covering hanger as set forth in claim 2 wherein the front face is spaced from the window frame.

6. A window covering hanger comprising:

a mounting bracket including a horizontally oriented top face, a vertically oriented rear face coupled to a rear edge of the top face and depending downwardly therefrom, and a front face coupled to the top face and depending downwardly therefrom, wherein the top face of the mounting bracket rests on a top ledge of a window frame and the rear face is situated between the window frame and an adjacent wall; and securement means mounted on the mounting bracket for securing to an end of a rod of a window covering;

wherein the securement means includes a tab extending outwardly from the mounting bracket;

wherein the tab has a height equal to that of the front face.

7. A window covering hanger as set forth in claim 6 wherein the securement means is coupled to the front face of the mounting bracket.

8. A window covering hanger as set forth in claim 6 wherein the top face has at least one aperture formed therein with a tack extending through the aperture for engaging the window frame.

9. A window covering hanger as set forth in claim 6 wherein the front face is spaced from the window frame.

* * * * *